US005799397A

United States Patent [19]

Yasuda et al.

[11] Patent Number: 5,799,397

[45] Date of Patent: Sep. 1, 1998

[54] PIPE WITH CLOSURE PORTION, HEAT EXCHANGER HEADER AND METHOD OF PRODUCING THEREFOR

[75] Inventors: Ryuji Yasuda, Kanagawa; Michito Saito; Hiroyuki Inaba, both of Tokyo, all of Japan

[73] Assignees: Calsonic Corporation, Tokyo; Caltec Corporation, Kanagawa, both of Japan

[21] Appl. No.: 708,935

[22] Filed: Sep. 6, 1996

Related U.S. Application Data

[63] Continuation-in-part of Ser. No. 412,454, Mar. 29, 1995, abandoned.

[30] Foreign Application Priority Data

Mar. 29, 1994 [JP] Japan ..... 6-059176
Sep. 7, 1995 [JP] Japan ..... 7-229927

[51] Int. Cl.[6] ..... B23P 15/26

[52] U.S. Cl. ..... 29/890.052; 29/890.053

[58] Field of Search ..... 29/890.03, 890.052, 29/890.053, 463

[56] References Cited

U.S. PATENT DOCUMENTS 5,119,552 6/1992 Sutou et al. ..... 29/890.052
5,348,083 9/1994 Hosoya et al. ..... 165/174
5,363,911 11/1994 Velluet et al. ..... 165/173
5,386,629 2/1995 Ouchi et al. ..... 29/890.046

FOREIGN PATENT DOCUMENTS 63-279094 11/1988 Japan ..... F28D 1/053

*Primary Examiner*—Irene Cuda
*Attorney, Agent, or Firm*—Sughrue, Mion, Zinn, Macpeak & Seas, PLLC

[57] ABSTRACT

In an end-closed pipe of a pair of half-cylindrical portions are opposed to each other to form a pipe portion, and part of an end portion of each of the half-cylindrical portions is folded or formed into a V-shaped or a U-shaped cross-section to form a half closure portion projecting from an inner surface thereof, and the half closure portions of the two half-cylindrical portions are bonded together so as to form a closure portion at the end portion of the pipe. Two closure portions are formed at the both ends of the pipe, and a partition portion which has same structure as that of the closure portion is formed between the two closure portions. In the heat exchanger header a plurality of tube insertion holes are formed in the above end-closed pipe, and are spaced from one another along an axis thereof.

27 Claims, 16 Drawing Sheets

PIPE WITH CLOSURE PORTION, HEAT EXCHANGER HEADER AND METHOD OF PRODUCING THEREFOR

CROSS REFERENCE TO RELATED APPLICATIONS

This application is a continuation-in-part of application Ser. No. 08/412,454, filed Mar. 29, 1995, now abn, which is hereby incorporated by reference in its entirety.

BACKGROUND OF THE INVENTION

1. Field of the Invention

This invention relates to a pipe having a partition formed within it and an end-closed pipe in which an end portion of a pipe portion is closed, and also a method of producing thereof. Further, this invention also relates to a heat exchanger header and a method of producing therefor.

2. Description of the Prior Art

In a heat exchanger for a condenser or the like, a partition has theretofore been formed within a header so as to change the flow passage of a fluid, as disclosed in Japanese Utility Model Unexamined Publication No. Hei. 4-63982.

In a conventional method of producing such a header (hereinafter referred to as "partitioned header") with a partition for a heat exchanger, a material, comprising an aluminum alloy material having a brazing material, clad or formed on its outer surface, is cut into a predetermined length to provide a pipe 11 for the header as shown in FIG. 27A. Thereafter, tube insertion holes 13, a divide-mounting slit 15, a fluid inlet port 17 and a fluid outlet port 19 are formed in the pipe 11 as shown in FIG. 27B. A divide 21, comprising an aluminum alloy material having a brazing material clad on this opposite sides or faces, is then inserted into the divide-mounting slit 15, and is provisionally secured thereto by argon arc welding, thereby partitioning the interior of the pipe 11 into two halves. A patch 23 of an aluminum alloy is press-fitted into each of the opposite ends of the pipe 11.

In order to produce a heat exchanger of the type within which a cooling medium makes a U-turn, one end of tubes of a core (which comprises alternately-stacked tubes (each comprising an aluminum alloy material having a brazing material clad on its outer surface) and fins (each made of an aluminum alloy having no brazing material clad thereon)) are fitted in the tube insertion hole 13 in the pipe whereas the other ends of the tubes are fitted respectively in tube insertion holes in a header with no partition, and these parts are fixed relative to each other by a jig or the like. Then, this assembly is heated in a furnace with a non-corrosive flux coated onto the relevant portions to be brazed, or heated in a vacuum furnace without coating a flux, so that the tubes and the fins are brazed to each other, and also the divide 21, the patches 23 and the tubes are brazed to the pipe 21. Reference numeral 25 in FIG. 27D designates the brazing of the divide 21, so that the interior of the pipe 11 is kept in a liquid-tight manner.

Such a conventional partitioned header for a heat exchanger is disadvantageous in that the cost of the material is high. Another problem is that the brazing of the divide 23 to the pipe 11 has sometimes been found defective. More specifically, the divide 21 is inserted into the slit 15 in the pipe 11, and is brazed to the slit 15 and to the inner surface of the pipe 11. To accomplish this brazing, the divide 21 comprises an aluminum alloy material having a brazing material clad on each side or face thereof. In theory, when the brazing material on the outer surface of the pipe 11 is drawn toward the area of brazing between the tube insertion hole 13 and the tube during the brazing, the brazing material on the divide is also drawn because the brazing material on the divide 23 is in contact with the brazing material on the pipe 11.

Further, since the patches 23 are press-fitted and brazed into each of the opposite ends of the pipe 11 to close the both ends of the pipe 11, the manufacturing steps are increased.

SUMMARY OF THE INVENTION

With the above problems in mind, it is an object of the invention to provide a pipe with a partition where the pipe is formed from a sheet, and has an integral partition portion, and an end-closed pipe in which an end portion of a pipe portion is closed.

Another object of the invention is to provide a method of producing the aforementioned pipes.

Still another object of the invention is to provide a method of producing a header with a partition for a heat exchanger, using the above pipes and a method of producing thereof.

According to a first aspect of the present invention, there is provided a method of producing a pipe with a partition, comprising the steps of: shaping a flat sheet into such a configuration that the sheet has a pair of half-cylindrical portions arranged in juxtaposed relation to each other and interconnected by a connecting portion disposed between the pair of half-cylindrical portions, and that a partition-forming portion of a U-shaped cross-section is formed on each of the pair of half-cylindrical portions, and is projected from an inner surface thereof; removing at least that portion of the connecting portion lying between the partition-forming portions of the pair of half-cylindrical portions; compressing each of the partition-forming portions from opposite sides thereof to form a half partition portion; bending the connecting portion to bring the pair of half-cylindrical portions into opposed relation to each other; mating the pair of opposed half-cylindrical portions with each other; and bonding the pair of mated half-cylindrical portions together.

According to a second aspect of the present invention, there is provided a method of producing a header with a partition, comprising the steps of: shaping a flat sheet to form a first header member which has a first half-cylindrical portion, and a partition portion of a generally U-shaped cross-section projected from an inner surface of the half-cylindrical portion; forming a second header member, the second header member-forming step comprising the steps of (i) shaping a flat sheet to form a second half-cylindrical portion having a partition-forming portion of a U-shaped cross-section projected from an inner surface thereof, (ii) removing at least those portions of opposite side edge portions of the second half-cylindrical portion disposed respectively at opposite ends of the partition-forming portion, (iii) compressing the partition-forming portion from opposite sides thereof to form a half partition portion, and (iv) forming tube insertion holes in the second half-cylindrical portion; and bonding the first and second header members together.

According to a third aspect of the present invention, there is provided a method of producing a header with a partition, comprising the steps of: forming a first header member, the first header member-forming step comprising the steps of (i) shaping a flat sheet to form a first half-cylindrical portion having a first partition-forming portion of a generally U-shaped cross-section projected from an inner surface thereof, (ii) removing at least those portions of opposite side edge portions of the half-cylindrical portion disposed respectively at opposite ends of the partition-forming portion, (iii) compressing the partition-forming portion from opposite sides thereof to form a first half partition portion; forming a second header member, the second header member-forming step comprising the steps of (iv) shaping a flat sheet to form a second half-cylindrical portion having a second partition-forming portion of a U-shaped cross-section projected from an inner surface thereof, (v) removing at least those portions of opposite side edge portions of the second half-cylindrical portion disposed respectively at opposite ends of the second partition-forming portion, (vi) compressing the second partition-forming portion from opposite sides thereof to form a second half partition portion, and (vii) forming tube insertion holes in the second half-cylindrical portion; and joining the first and second header members together to form a header having a pipe-like configuration.

According to a fourth aspect of the present invention, there is provided a method of producing an end-closed pipe in which an end portion is closed, comprising the steps of: shaping a flat sheet into such a configuration that the sheet has a pair of half-cylindrical portions arranged in juxtaposed relation to each other and interconnected by a connecting portion disposed between the pair of half-cylindrical portions, and that a closure-forming portion of a U-shaped cross-section is formed on each of the pair of half-cylindrical portions at the end thereof, and is projected from an inner surface thereof; removing at least that portion of the connecting portion lying between the closure-forming portions of the pair of half-cylindrical portions; compressing each of the closure-forming portions from opposite sides thereof to form a half closure portion; bending the connecting portion to bring the pair of half-cylindrical portions into opposed relation to each other; mating the pair of opposed half-cylindrical portions with each other; and bonding the pair of mated half-cylindrical portions together.

According to a fifth aspect of the present invention, there is provided a method of producing a header of which end portion is closed, comprising the steps of: shaping a flat sheet to form a first header member which has a first half-cylindrical portion, and a closure portion of a generally U-shaped cross-section projected from an inner surface of the half-cylindrical portion; forming a second header member, the second header member-forming step comprising the steps of (i) shaping a flat sheet to form a second half-cylindrical portion having a closure-forming portion of a U-shaped cross-section projected from an inner surface thereof, (ii) removing at least those portions of opposite side edge portions of the second half-cylindrical portion disposed respectively at opposite ends of the closure-forming portion, (iii) compressing the closure-forming portion from opposite sides thereof to form a half closure portion, and (iv) forming tube insertion holes in the second half-cylindrical portion; and bonding the first and second header members together.

According to a sixth aspect of the present invention, there is provided a method of producing a header of which end portion is closed, comprising the steps of: forming a first header member, the first header member-forming step comprising the steps of (i) shaping a flat sheet to form a first half-cylindrical portion having a first closure-forming portion of a generally U-shaped cross-section projected from an inner surface thereof, (ii) removing at least those portions of opposite side edge portions of the half-cylindrical portion disposed respectively at opposite ends of the closure-forming portion, (iii) compressing the closure-forming portion from opposite sides thereof to form a first half closure portion; forming a second header member, the second header member-forming step comprising the steps of (iv) shaping a flat sheet to form a second half-cylindrical portion having a second closure-forming portion of a U-shaped cross-section projected from an inner surface thereof, (v) removing at least those portions of opposite side edge portions of the second half-cylindrical portion disposed respectively at opposite ends of the second closure-forming portion, (vi) compressing the second closure-forming portion from opposite sides thereof to form a second half closure portion, and (vii) forming tube insertion holes in the second half-cylindrical portion; and joining the first and second header members together to form a header having a pipe-like configuration.

According to a seventh aspect of the present invention, there is provided an end-closed pipe comprising: a pipe portion having a pair of half-cylindrical portions which are opposed to each other; and a closure portion which closes an end portion of the pipe portion; wherein the closure portion comprises two half closure portion, each half closure portion is formed by folding or forming an end portion of each of the half-cylindrical portions into a V-shaped or a U-shaped cross-section, the half closure portions project from an inner surface of the half-cylindrical portion and are bonded together.

According to an eighth aspect of the present invention, there is provided a header for a heat exchanger comprising: a pipe portion having a pair of half-cylindrical portions which are opposed to each other, a plurality of tube insertion holes being formed in one of the half-cylindrical portions in such a manner that they are spaced from one another along an axis of the half-cylindrical portion; and a closure portion which closes an end portion of the pipe portion; wherein the closure portion comprises two half closure portion, each half closure portion is formed by folding or forming an end portion of each of the half-cylindrical portions into a V-shaped or a U-shaped cross-section, the half closure portions project from an inner surface of the half-cylindrical portion and are bonded together.

DETAILED DESCRIPTION OF THE PREFERRED EMBODIMENTS

A method of the present invention will now be described in detail with reference to the drawings.

Figure 1:
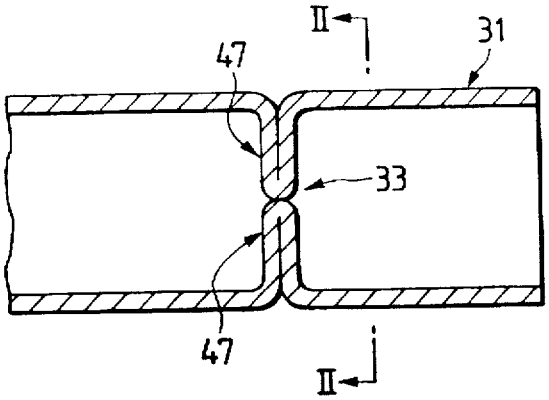
FIG. 1 is a cross-sectional view of a portion of a pipe with a partition produced by a partitioned pipe-producing method of the invention.
Figure 2:
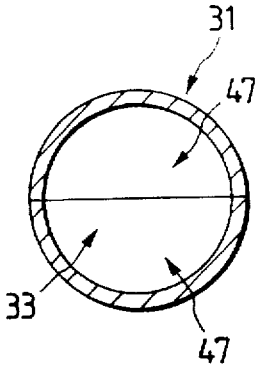
FIG. 2 is a cross-sectional view taken along the line II—II of FIG. 1.

FIGS. 1 and 2 show a pipe with a partition (hereinafter referred to as "partitioned pipe") produced by a method of the present invention. This partitioned pipe comprises a cylindrical pipe portion 31, and a partition portion 33 formed within this pipe portion 31 at a central portion thereof.

The partitioned pipe is produced in the following manner.

Figure 10:
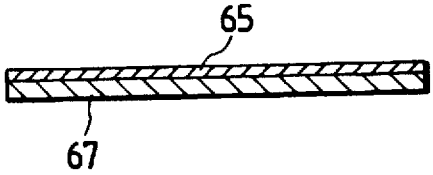
FIG. 10 is a cross-sectional view of a portion of a sheet used in the pipe-producing method of the invention.

In this embodiment, as shown in FIG. 10, the material for forming the pipe is an aluminum alloy sheet 67 having a brazing material layer 65 clad or formed on one side or surface thereof which serves as an outer peripheral surface of the resulting pipe portion 31.

Figure 3A:
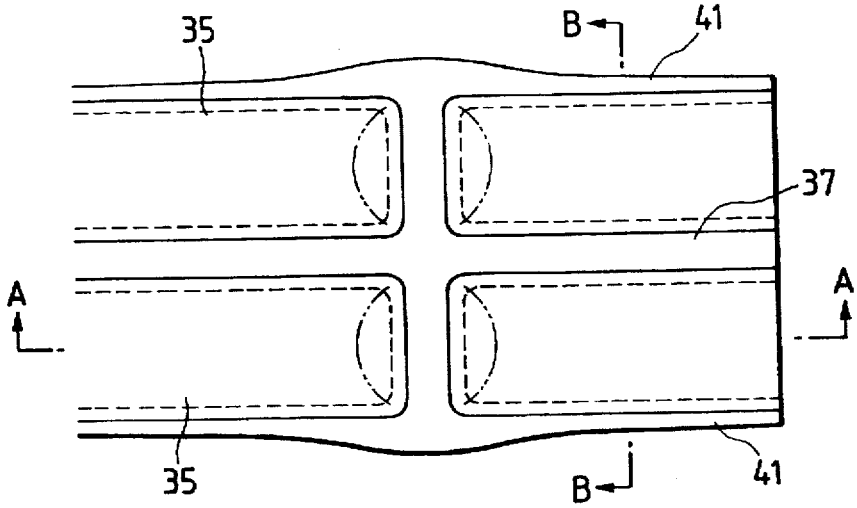
FIGS. 3A to 3C are views showing a shaping process of the partitioned pipe-producing method.
Figure 3C:
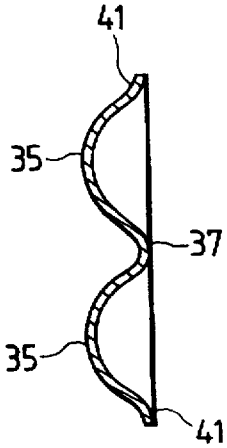
Figure 3B:
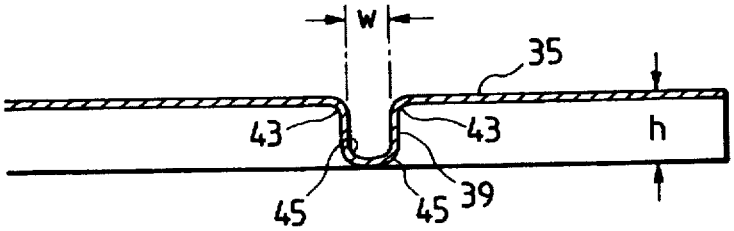

First, in a shaping process shown in FIGS. 3A–3C, the sheet 67 is formed or shaped to have a pair of half-cylindrical (semi-cylindrical) portions 35. The half-cylindrical portions 35 are arranged side by side (that is, in juxtaposed relation to each other), and are interconnected by a connecting portion 37 disposed therebetween.

Each of the pair of half-cylindrical portions 35 has a partition-forming portion 39 of a U-shaped cross-section projected from an inner surface thereof. The radius of each half-cylindrical portion 35 is smaller by about 2 mm than the radius of the pipe portion 31 to be formed, and an edge portion 41 is formed at an outer side edge of the half-cylindrical portion 35.

The above shaping process is carried out by holding the flat sheet between dies and pressing. For example, for producing the partitioned pipe having a wall thickness of 1.5 mm and an outer diameter of 22 mm, the partition-forming portion 39 has a height h of 9 mm and a width w of 8 mm, and in this partition-forming portion 39, the radius of a pair of curved portions 43 is 2 mm, and the radius of a curved portion 45 is 3.5 mm (See FIG. 3B).

Figure 4A:
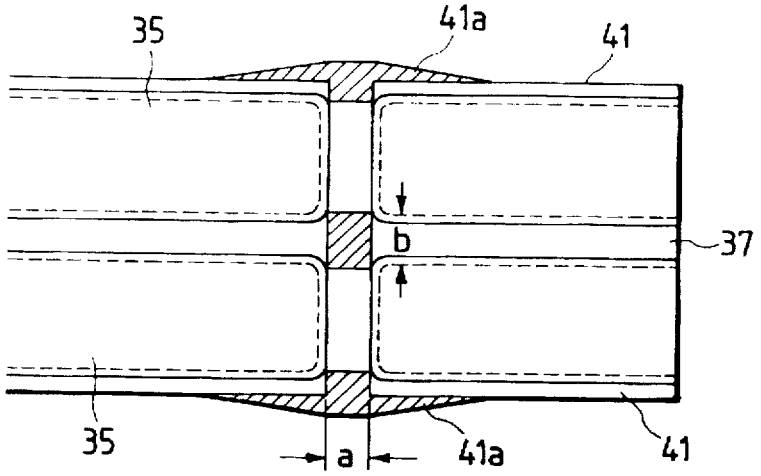
FIGS. 4A and 4B are views showing a removing process of the partitioned pipe-producing method.

Thereafter, in a cutting or removing process shown in FIG. 4, that portion of the connecting portion 37 lying between the partition-forming portions 39 of the pair of half-cylindrical portions 35, and those portions of the edge portions 41 disposed immediately adjacent respectively to outer ends of the partition-forming portions 39, and excess portions 41*a* are removed. These portions to be removed are indicated by cross-hatching in FIG. 4A.

This removing (cutting) process is carried out by a trim piercing process, using a pressing machine. By way of example, when producing a partitioned pipe having an outer diameter of 22 mm, the dimension a of that portion of the connecting portion 37 to be cut in the axial direction is 8 mm, and the dimension b of that portion of the connecting portion 37 to be cut in a direction perpendicular to the axial direction is 9.5 mm. In this case, the inner diameter of the connecting portion 37 is equal to that of the pipe.

Figure 5A:
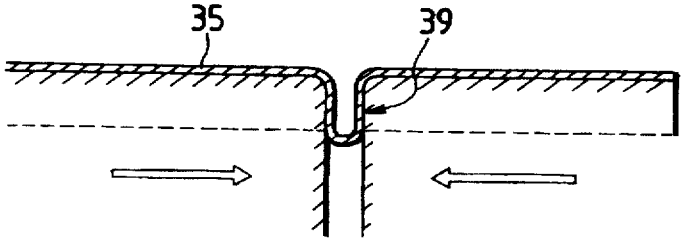
FIGS. 5A and 5B are views showing a compressing process of the partitioned pipe-producing method.
Figure 5B:
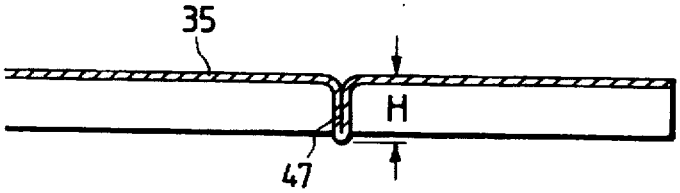

Thereafter, in a compression process shown in FIG. 5, the partition-forming portion 39 of each of the half-cylindrical portions 35 is compressed from opposite sides thereof to provide a half partition portion 47.

Figure 6A:
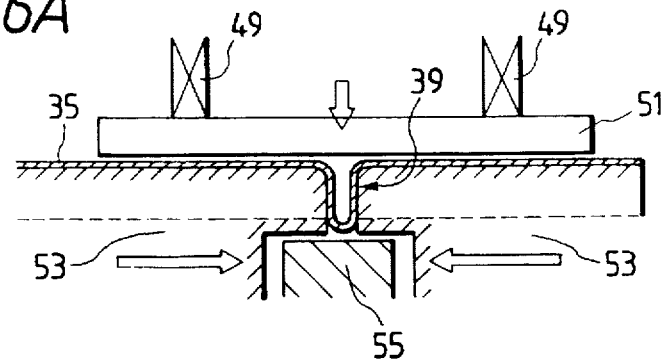
FIGS. 6A and 6B are views showing the compressing process of FIG. 5 in detail.
Figure 6B:
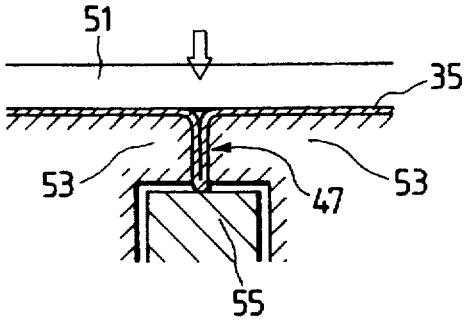

With reference to FIG. 6, this compression process is carried out by a method in which a workpiece holder 51 urged by springs 49 is pressed against the outer surfaces of the half-cylindrical portions 35 while a pair of compressing members 53 are received in the half-cylindrical portions 35, and are arranged respectively on the opposite sides of the partition-forming portions 39. Thereafter, the partition-forming portions 39 are compressed and shaped by the compressing members 53.

In this embodiment, a dimension correction block 55 is placed between the compressing members 53, and the length H (see FIG. 5B) that the half partition portion 47 projects from the inner surface of the half-cylindrical portion 35 is corrected by the dimension correction block 55. Also, the thickness of the half partition portion 47 is determined by the amount of compression by the compressing members 53.

As an example, in the case of producing the partitioned pipe having an outer diameter of 22 mm, the height H of the half partition portion 47 is corrected into 11 mm by the dimension correction block 55.

Figure 7A:
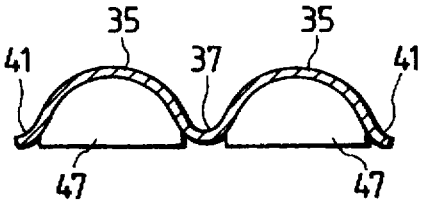
FIGS. 7A and 7B are views showing an edge-forming process of the partitioned pipe-producing method.
Figure 7B:
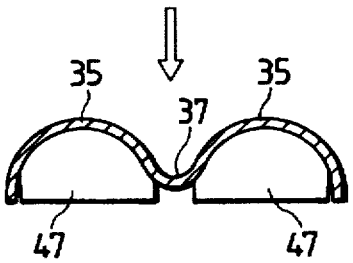

Then, in an edge-forming process shown in FIGS. 7A and 7B, the edge portions 41 at the outer side edge of each half-cylindrical portion 35 is formed into an arcuate shape conforming to the half-cylindrical portion 35, as shown in FIG. 7B.

This edge-forming process is carried out by holding the pair of half-cylindrical portions 35 between predetermined dies, and then by shaping the edge portions 41 by pressing.

Figure 8A:
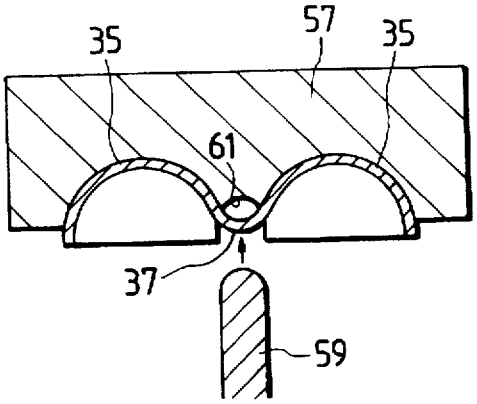
FIGS. 8A and 8B are views showing an opposing process of the partitioned pipe-producing method.
Figure 8B:
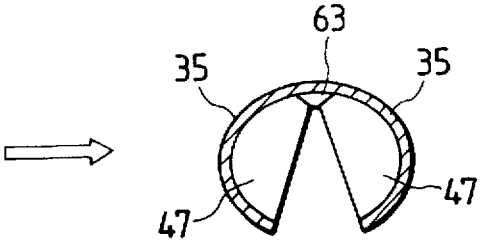

Then, in an opposing process shown in FIGS. 8A and 8B, the connecting portion 37 is bent from the inside thereof to fold the pair of half-cylindrical portions 35 into opposed relation to each other.

This process is carried out by a method in which the outer surfaces of the half-cylindrical portions 35 are received in a die 57, and the connecting portion 37 is pressed into a recess 61 of an arcuate cross-section by a punch 59.

Figure 4B:
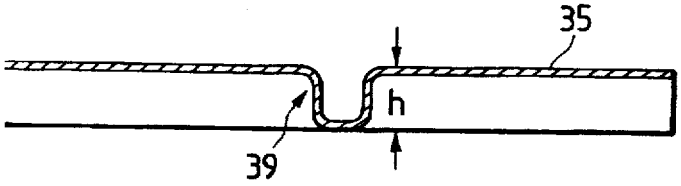

In this embodiment, when producing the partitioned pipe having an outer diameter of 22 mm, in the removing process shown in FIGS. 4A and 4B, the dimension a corresponding to the distance by which the connecting portion 37 is cut in the axial direction is 8 mm, and the dimension b corresponding to the distance in which the connecting portion 37 is cut in the direction perpendicular to the axial direction is 9.5 mm. Therefore, a gap 63, formed adjacent to the connecting portion 37, can be made to a minimum when the pair of half-cylindrical portions 35 opposed each other. Namely, the dimensions a and b are so determined that the gap 63, formed adjacent to the connecting portion 37 is minimized.

Figure 9A:
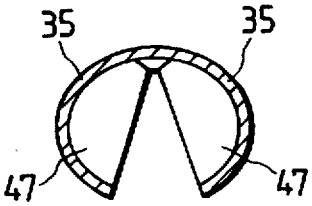
FIGS. 9A and 9B are views showing a mating process of the partitioned pipe-producing method.
Figure 9B:
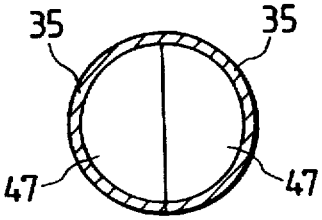

Turning to FIGS. 9A and 9B, in a mating step the pair of opposed half-cylindrical portions 35 are mated with each other. This mating process is carried out by placing the outer surfaces of the half-cylindrical portions 35 respectively in a pair of dies (not shown), and then by moving the dies toward each other, so that the pair of half-cylindrical portions 35 jointly form a pipe configuration.

Thereafter, a bonding process is carried out in which the pair of half-cylindrical portions 35, as well as the pair of half partition portions 47, are bonded together. This bonding process is carried out by brazing using a non-corrosive flux, but may be carried out by vacuum brazing.

For the purpose of coating the non-corrosive flux, the sheet material, having the brazing material layer 65 clad on its one surface serving as the outer surface of the resulting pipe, is used in this embodiment. The brazing material is characterized in that, when molten, it tends to seep into a narrow gap to thereby effect the brazing.

The brazing, employing such a brazing material, is carried out in such a state that the edge portions 41 to be bonded together are disposed underside of the the pair of half cylindrical portions 35. By doing so, the brazing can be achieved more satisfactorily due to gravity. By changing the materials, various other bonding methods can be used.

The process of removing the edge portions 41 may be performed after the edge-forming process. It is important that the bottom (FIG. 7B) of each edge portion 41 and the bottom of each half partition portion 47 lie in a common plane so that when the pair of half-cylindrical portions 35 are mated together to form a pipe configuration, a gap between the two edge portions 41, as well as a gap between the two half partition portions 47, can be made narrow (preferably not more than 0.1 mm); otherwise, the brazing of these portions would be adversely affected.

In the above method of producing the partitioned pipe, the partition-forming portions 39 of a U-shaped cross-section, formed respectively on the pair of half-cylindrical portions 35, are compressed from the opposite sides thereof to form the half partition portions 47, respectively. Then, when the pair of half-cylindrical portions 35 are mated with each other, the two half partition portions 47 jointly form the partition portion 33. Therefore, the partitioned pipe, having the partition portion 33 formed integrally therewith, can be easily produced from the single sheet material.

Therefore, there is no need to use an expensive pipe material preformed into a cylindrical shape, and the material cost can be reduced greatly as compared with the conventional method.

Figure 28:
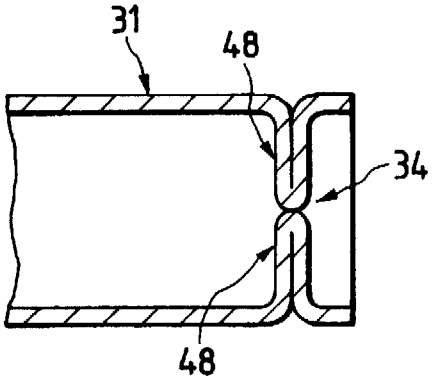
FIG. 28 is a cross-sectional view of a portion of a pipe with a closure portion produced by an end-closed pipe-producing method of the invention.

FIG. 28 shows an end-closed pipe produced using the above described method. This pipe comprises a closure portion 34 formed within the pipe portion 31 at an end portion thereof. The closure portion 34 comprises half closure portions.

In the producing steps of the end-closed pipe, a closure-forming portion (partition-forming portion) is formed on each of the pair of half cylindrical portions at the end thereof. As another method, before or after the above bonding process, the outside portion of the closure portion 34 of the pipe portion 31 may be cut away in accordance with the specification or request to remove the needless portion. The other steps, that is, to form the end closure portion 48 are same as that of the partioned pipe. Therefore, the end portion of the pipe portion 31 is closed by the closure portion 34 easily and surely without a patch or the like.

A first example of a method of producing a header (hereinafter referred to as "partitioned header") with a partition of the invention for a heat exchanger will now be described.

Figure 11A:
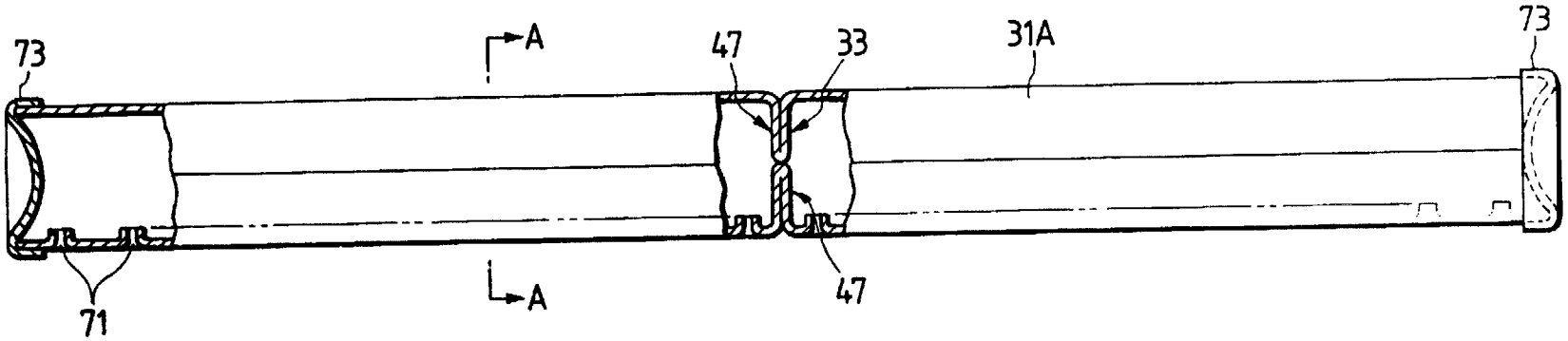
FIGS. 11A and 11B are views showing a partitioned header for a heat exchanger produced by a first example of partitioned header-producing method of the invention.
Figure 11B:
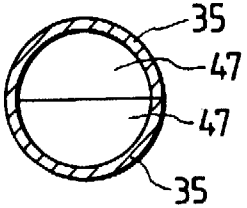

FIGS. 11A and 11B show a partitioned header for a heat exchanger produced according to this embodiment, which comprises a cylindrical pipe portion 31A, and a partition portion 33 formed within the pipe portion 31A at a central portion thereof. Tube insertion holes 71 are formed through the pipe portion 31A at one side of an outer periphery thereof, and are spaced at predetermined intervals along the length of the pipe portion 31A. Opposite open ends of the pipe portion 31A are closed by lid members 73, respectively.

In this method of producing the partitioned header for a heat exchanger, a sheet 67 of aluminum having a brazing material layer 65 clad on one surface thereof serving as an outer peripheral surface of the resulting pipe portion 31A is used, and a pair of half-cylindrical portions 35, as well as a pair of half partition portions 47, are brazed together in a bonding process, as described above for the method of producing the partitioned pipe.

Figure 12:
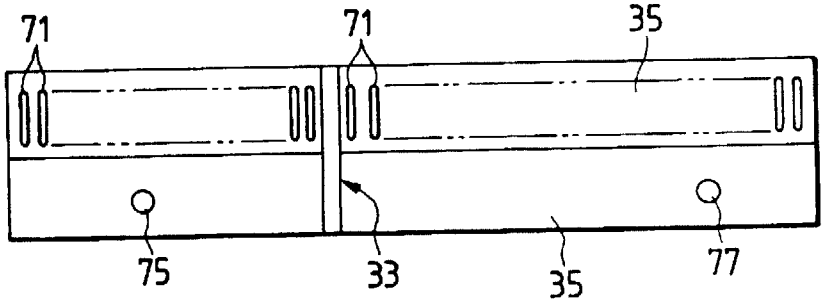
FIG. 12 is a view showing a tube insertion hole-forming process of the first example of partitioned header-producing method.

In this embodiment, after an edge-forming process (see FIGS. 7A and B), the tube insertion holes 71, spaced at predetermined intervals, are formed in one of the half-cylindrical portions 35, as shown in FIG. 12. At the same time, a fluid inlet port 75 for introducing a heat transfer medium (cooling medium) into the header, as well as a fluid outlet port 77 for discharging this medium from the header, is formed in the half-cylindrical portion 35. This process is carried out by a slit-piercing process, using a pressing machine.

In the method of producing the partitioned header for the type of heat exchanger within which the cooling medium is cycled once, the bonding process is carried out in the following manner. The tube insertion holes 71, formed in the pipe portion 31A having the lid members 73 fitted respectively on the opposite ends thereof, are fitted on one end of each tube of a core portion (comprising fins and the tubes) of the heat exchanger whereas tube insertion holes in a header with no partition are fitted respectively on the other ends of the tubes, and in this condition these parts are fixed relative to each other by a jig or the like. Then, the bonding between the pair of half-cylindrical portions 35, between the pair of half partition portions 47, between the lid members 73 and the pipe portion 31A, between the tubes and the tube insertion holes 71, and between the tubes and the fins are effected by vacuum brazing or a brazing method in which a non-corrosive flux is coated onto those portions to be brazed, and the brazing is effected, for example, in an atmosphere of nitrogen.

When the brazing is to be applied to the heat exchanger in a prefixed condition, those portions of the pipe portion 31A to be bonded together are directed downwardly. By doing so, the brazing material, when molten, collects on these pipe bonding portions by gravity, and is drawn into a narrow gap between the pipe bonding portions and also into a gap between the pair of half partition portions, thereby enhancing the brazing ability.

In the above method of producing the partitioned header for a heat exchanger, partition-forming portions 39 of a U-shaped cross-section, formed respectively on the pair of half-cylindrical portions 35, are compressed from the opposite sides thereof to form the half partition portions 47, respectively. Thereafter, when the pair of half-cylindrical portions 35 are mated with each other, the two half partition portions 47 jointly form the partition portion 33, as described above for the method of producing the partitioned pipe. Therefore, the pipe portion 31A, having the partition portion 33 formed integrally therewith, can be easily produced from the single sheet material.

Based on the foregoing, there is no need to use an expensive pipe material preformed into a cylindrical shape, and the material cost can be reduced greatly as compared with the conventional method.

In contrast with the conventional method using a cylindrical pipe, the partition is formed integrally with the pipe portion, and therefore the number of component parts is reduced, and hence the cost can be reduced. Since the brazing of the partition portion is effected within the header, leakage of the cooling medium to the exterior due to defective brazing of the partition portion is prevented, thereby enhancing the brazing ability. Finally, since the tube insertion holes can be formed in a semi-circular shape, a tube insertion hole-forming die has sufficient strength, and the time required for forming the tube insertion holes can be shortened, which also reduces the cost.

Figure 29:
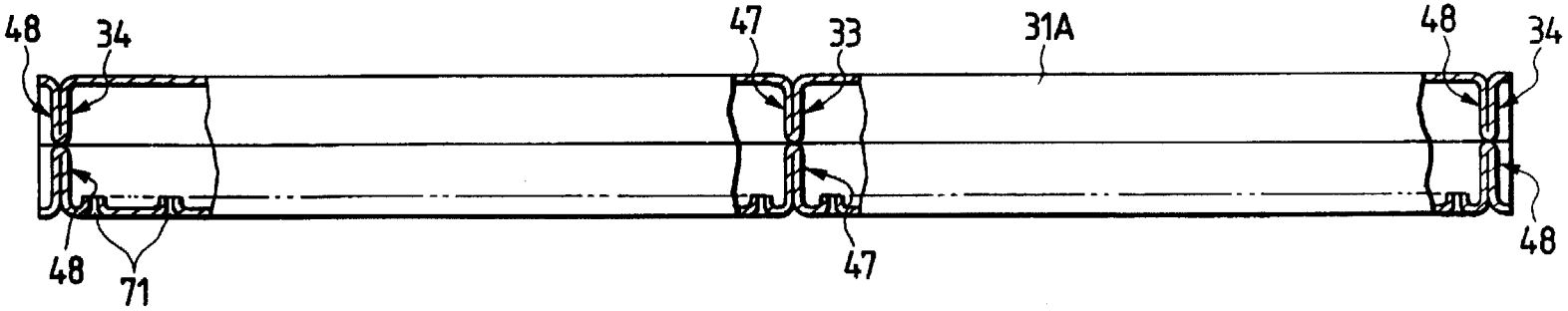
FIG. 29 is a side view showing an end-closed header for a heat exchanger produced by the similar manner such as that of the partitioned header shown in FIGS. 11A and 11B.

FIG. 29 shows an embodiment of a header of which both end portions are closed (hereinafter referred to as "end-closed header") according to the above method. In this end-closed header, closure portions 34 are formed at the both ends by the same method as that of the partition portion 33.

A second example of a method of producing a partitioned header for a heat exchanger will now be described.

In this embodiment, there is used a sheet of an aluminum alloy having a brazing material layer 65 clad on one surface thereof serving as an outer peripheral surface of the resulting pipe portion 31 (See FIG. 10).

Figure 13D:
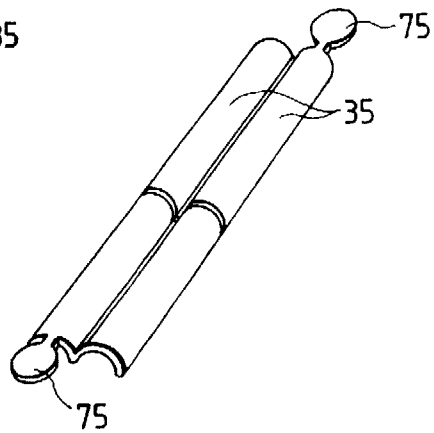
FIGS. 13A to 13G are views showing a sequence of processes in a second example of method of the invention for producing a partitioned header for a heat exchanger.
Figure 13C:
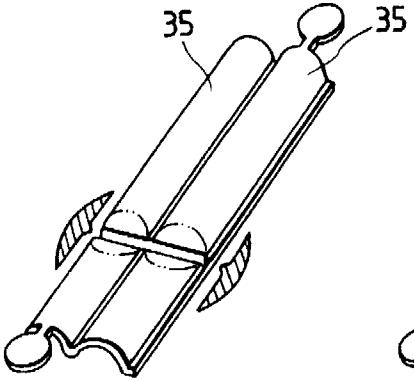
Figure 13B:
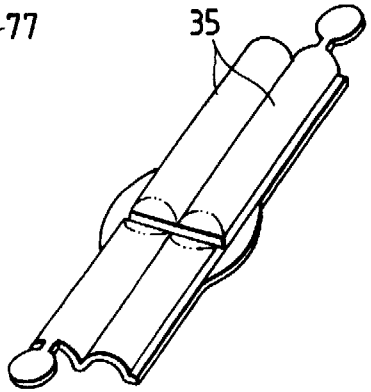
Figure 13A:
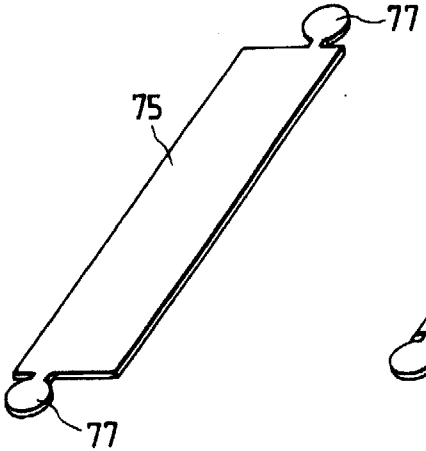
Figure 13G:
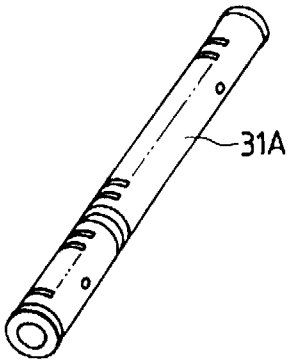
Figure 13F:
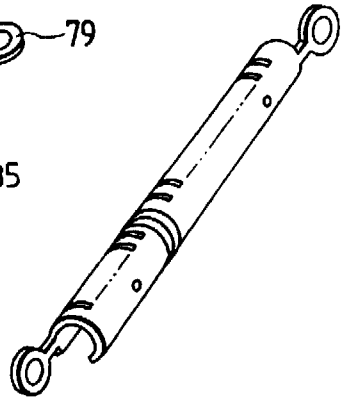
Figure 13E:
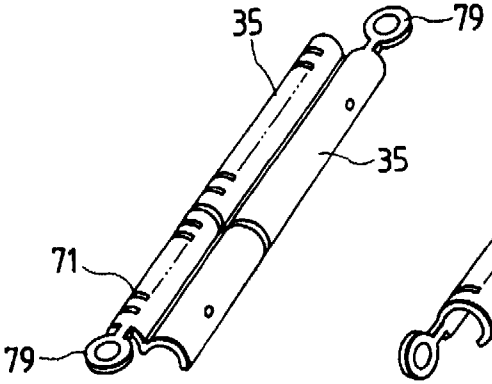

In this embodiment, in a removing process performed before a shaping process, a pair of lid members 77 of a circular shape are formed integrally on opposite ends of the sheet 75, respectively, as shown in FIG. 13A, and a projected portion 79 is formed on each of the lid members 77 by pressing when tube insertion holes 71 are formed in a half-cylindrical portion 35, as shown in FIG. 13E.

Then, in a process (FIG. 13F) before a bonding process, the opposite ends of a pipe portion 31A are respectively inserted into the projected portions 79 of the two lid members 77, and are brazed thereto in the bonding process. In this embodiment, the lid members 77 are also formed from the single sheet material.

Figure 14:
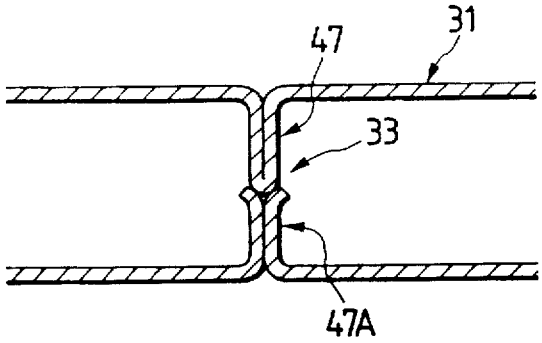
FIG. 14 is a cross-sectional view showing a partition portion in a modified method of the invention.

In the above embodiments, although the pair of half partition portions 47 have the same shape, and are brazed together at their distal ends, the present invention is not to be limited to such an arrangement. For example, there may be used an arrangement (see FIG. 14) in which one of the half partition portions 47 is cut at its distal end along a median plane thereof, and the thus cut end is opened in the direction of the length of the half-cylindrical portion 35, and the other half partition portion 47 is held against this opened end.

Figure 15A:
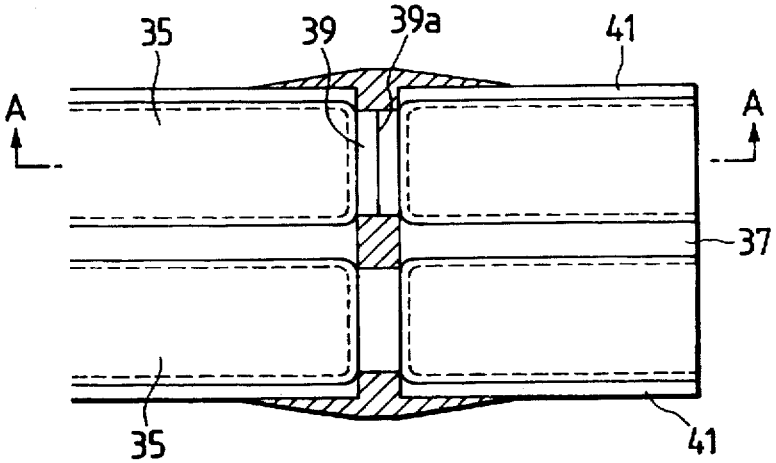
FIGS. 15A to 15C are views showing a process of forming the partition portion of FIG. 14.
Figure 15B:
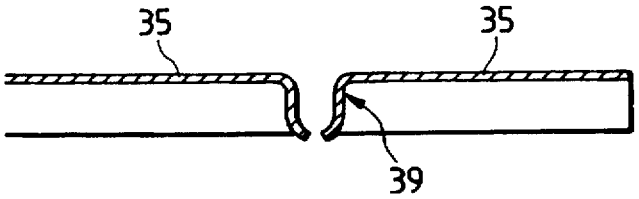
Figure 15C:
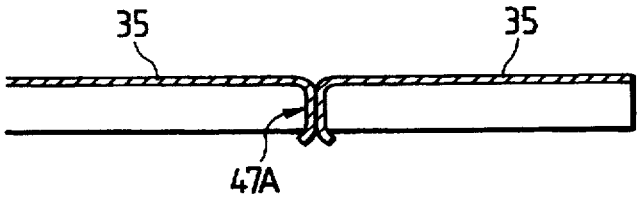

In this producing method (see FIGS. 15A, 15B and 15C), one partition-forming portion 39 is cut at its distal end along a median plane thereof to have a slit **39*a* in a removing process shown in FIG. 15A, and this cut end of the one partition-forming portion 39 is formed into a V-shaped or a U-shaped cross-section by a jig in a compressing process shown in FIG. 15C**.

In this producing method, the distal end of one half partition portion 47 serves as a reception portion for receiving the brazing material, and therefore the pair of half partition portions 47 and 47A can be brazed together more positively.

This method is applicable for producing the closure portion 34 at the end of the pipe portion 31.

Figure 16A:
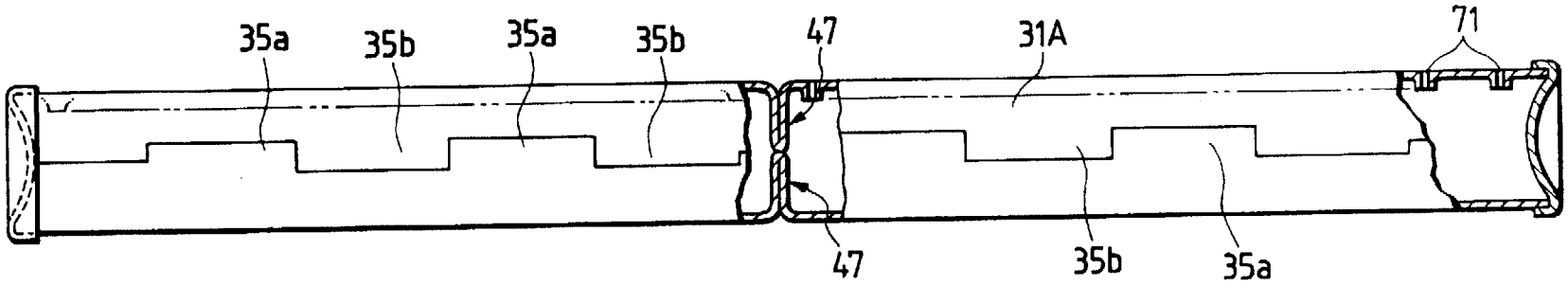
FIGS. 16A to 16C are views explanatory of a modified method of bonding a pair of half-cylindrical portions.
Figure 16B:
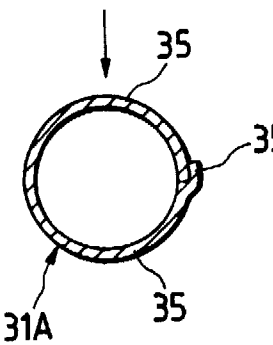
Figure 16C:
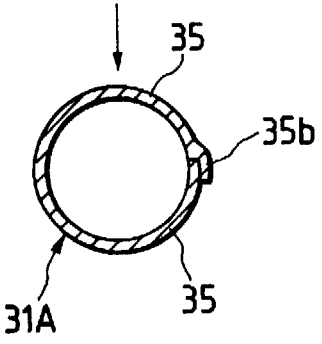

In the above embodiments, the pair of half-cylindrical portions 35 has the same shape, and their edges are bonded together by brazing; however, the present invention is not to be limited to such an arrangement. For example, there may be used an arrangement (see FIGS. 16A, 16B and 16C) in which projections **35*a* are formed at predetermined intervals on an outer side edge of one half-cylindrical portion 35 whereas projections 35*b* are formed at predetermined intervals on an outer side edge of the other half-cylindrical portion 35 in such a manner that the projections 35*a* and 36*b* are alternately disposed, and are held firmly against the outer surfaces of their mating half-cylindrical portions 35, respectively, when the pair of half-cylindrical portions 35 are mated together. With this arrangement, the strength of the pipe portion 31A** in the axial direction is increased.

Figure 17A:
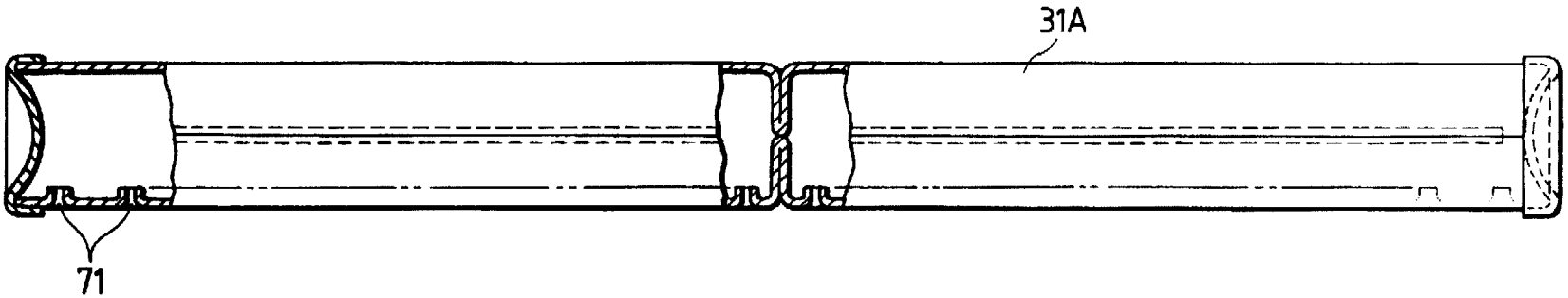
FIGS. 17A to 17C are views explanatory of another modified method of bonding a pair of half-cylindrical portions.

Additionally, there may be used an arrangement (see FIGS. 17A, 17B and 17C) in which a bent portion **35*c* is formed on an outer side edge of each of the pair of half-cylindrical portions 35, and these bent portions 35*c* are abutted against each other when the pair of half-cylindrical portions 35** are mated together.

With this arrangement, even if the brazing material layer 65 is formed only the outer peripheral surface of the pipe portion 31A, that portion of the brazing material layer 65 formed on one bent portion **35*c* can be disposed in contiguous relation to that portion of the brazing material layer 65 formed on the other bent portion 35*c***, so that the brazing can be carried out more positively.

Figure 17C:
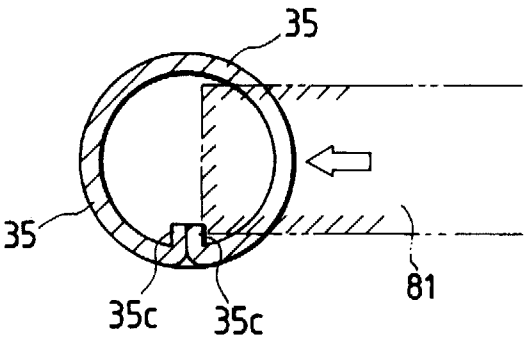
Figure 17B:
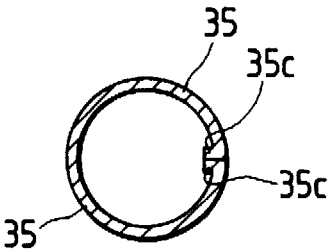

Furthermore, the positioning of a tube 81 can be effected accurately by abutting a distal end of the tube 81 against the bent portion **31*c*, as shown in FIG. 17C**.

In the above methods of producing the partitioned header for a heat exchanger, although the tube insertion holes 71 are formed after the edge-forming process, the present invention is not to be limited to such embodiments, and the tube insertion holes 71 may be formed at any stage before the bonding process, and may be formed, for example, in the cutting process.

Figure 18A:
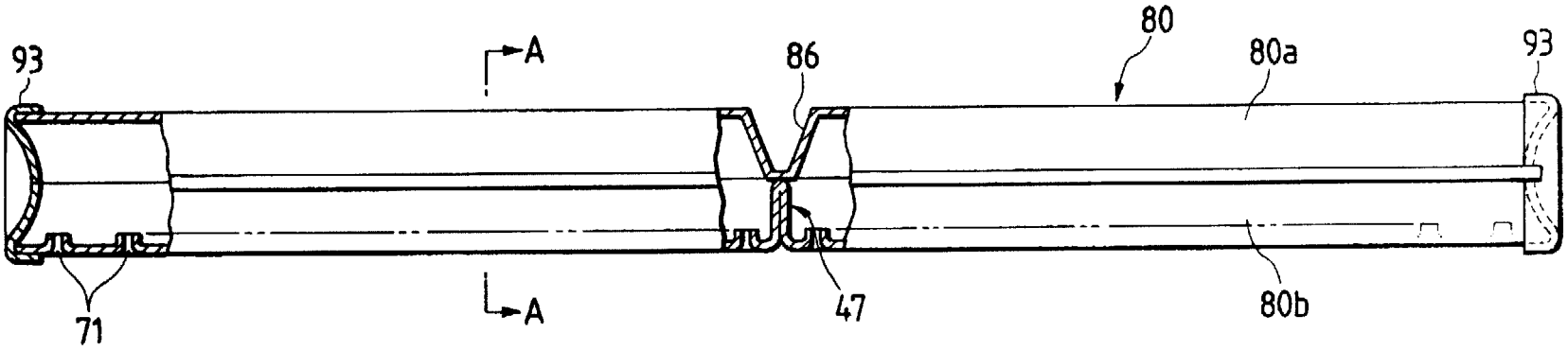
FIGS. 18A and 18B are views showing a partitioned header for a heat exchanger produced by a third example of partitioned header-producing method of the invention.
Figure 18B:
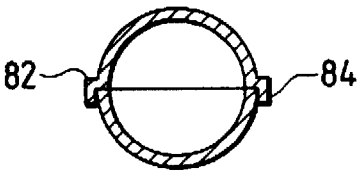

A partitioned header for a heat exchanger, produced by a third embodiment of a method of the present invention, comprises a first header member 80*a* and a second header member 80*b*, as shown in FIGS. 18A and 18B. As shown, the first header member 80*a* has a semi-cylindrical (half-cylindrical) shape, and has a half partition portion 86 of a generally U-shaped cross-section formed at a generally central portion thereof in a recessed manner. Flanges 84 are formed respectively on opposite side edge portions 82 to be brazed to the second header member 80*b*.

The second header member 80*b* has a semi-cylindrical shape, and has a half partition portion 47 formed at that portion thereof corresponding to the half partition portion 86 of the first header member 80*a*. Tube insertion holes 71 are formed in an apex portion of the semi-cylindrical second header member 80*b*, and are spaced at predetermined intervals along the length thereof.

The first and second header members 80*a* and 80*b* are mated together at their open sides to form a cylindrical pipe, and opposite ends of this cylindrical pipe are closed by lid members 93, respectively.

A method of producing the first header member 80*a* will now be described.

A sheet 67 (see FIG. 10) of an aluminum alloy, having a brazing material layer 65 formed on one surface thereof serving as an outer peripheral surface of the resulting first header member 80*a*, is used for forming the first header member 80*a*.

Figure 19:
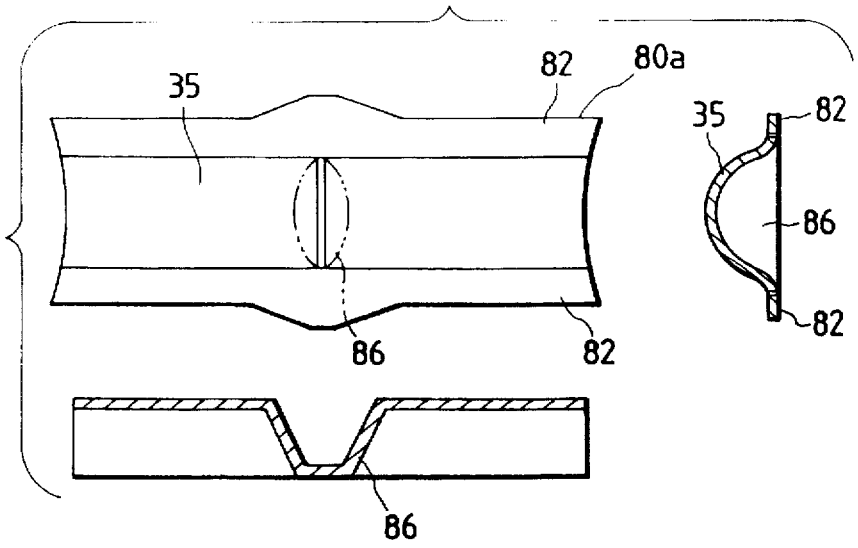
FIG. 19 shows a shaping process for a first header member in the third example of partitioned header-producing method.

In a shaping process shown in FIG. 19, the sheet 67 is shaped to have a half-cylindrical portion 35. At the same time, the half partition portion 86 of a V-shape (or a U-shape) is formed on the half-cylindrical portion 35.

At this time, the bottom of the half partition portion 86 and the bottom surface of the edge portions 82 lie in a common plane. Namely, the radius of the half-cylindrical portion 35 is equal to the radius of the header 80, and in the case of a partitioned header having an outer diameter of 22 mm, the radius of the half-cylindrical portion 35 is 11 mm.

Figure 20:
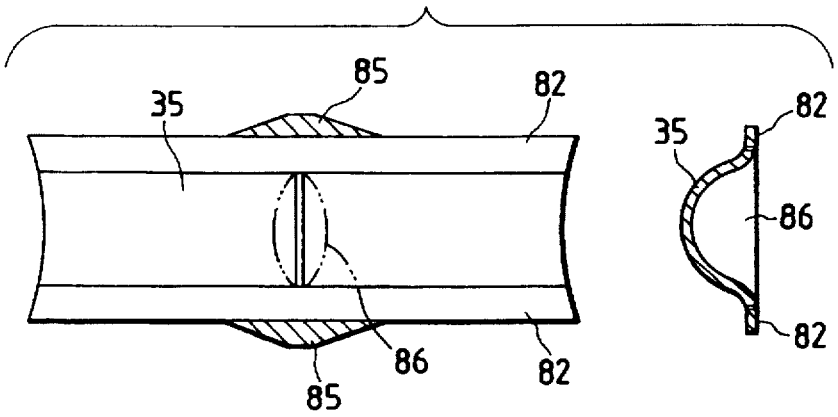
FIG. 20 shows a removing process for the first header member in the third example of partitioned header-producing method.

Then, excess portions 85 (see FIG. 20) are removed. In this embodiment, since no tube insertion hole is formed in the first header member 80*a*, the half partition portion 47 does not need to be compressed as in FIGS. 5 and 6. Therefore, here, it is only necessary to remove the excess portions 85.

Figure 21:
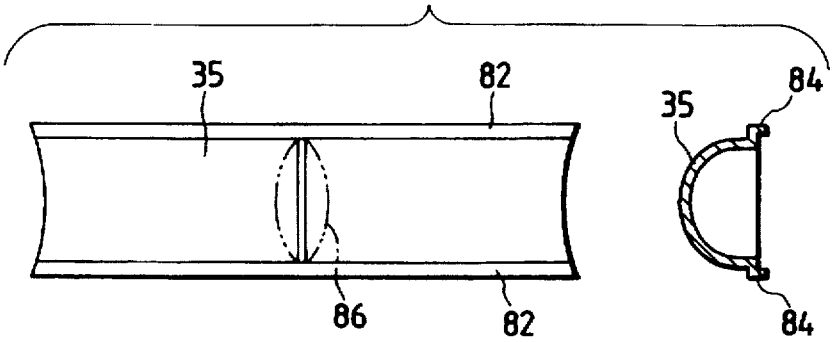
FIG. 21 shows a flange-forming process for the first header member in the third example of partitioned header-producing method.

Then, each of the opposite side edge portions 82 is bent to form the flange 84, as shown in FIG. 21. The removal of the excess portions 85 and the formation of the flanges 84 may be effected at the same time.

In a method of forming the second header member 80*b*, a sheet 67 (see FIG. 10) of an aluminum alloy, having a brazing material layer 65 formed on one surface thereof serving as an outer peripheral surface of the resulting second header member 80*b*, is used as described above for the first header member 80*a*.

Figure 22:
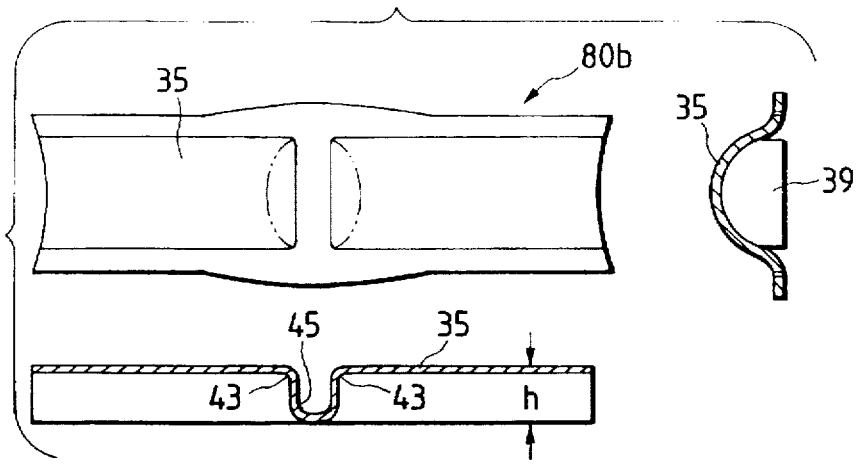
FIG. 22 shows a shaping process for a second header member in the third example of partitioned header-producing method.

The method of forming the second header member 80*b* is basically the same as the method of forming one half-cylindrical portion in the first example of method of producing the partitioned header for a heat exchanger. First, a second half-cylindrical portion 35 is formed as shown in FIG. 22. This half-cylindrical portion 35 has a partition-forming portion 39 of a U-shaped cross-section projected from an inner surface thereof.

Figure 23:
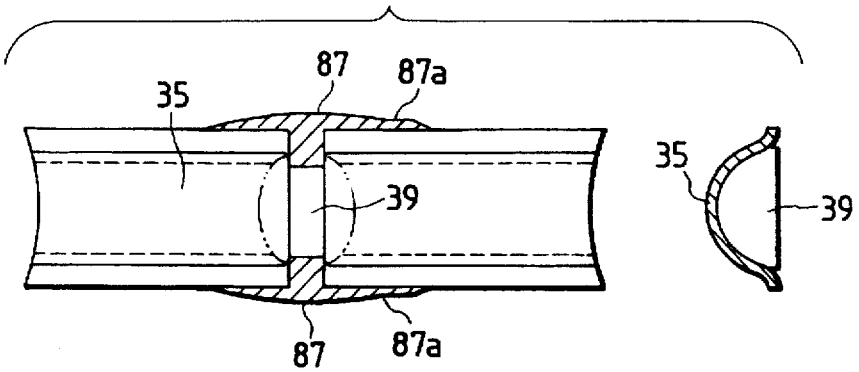
FIG. 23 shows a removing process for the second header member in the third example of partitioned header-producing method.

Then, in a cutting process, those portions of opposite side edge portions 87 disposed immediately adjacent respectively to opposite ends of the partition-forming portion 39, as well as excess portions 87*a*, are removed by cutting. These portions to be removed are indicated by hatching in FIG. 23.

Figure 24:
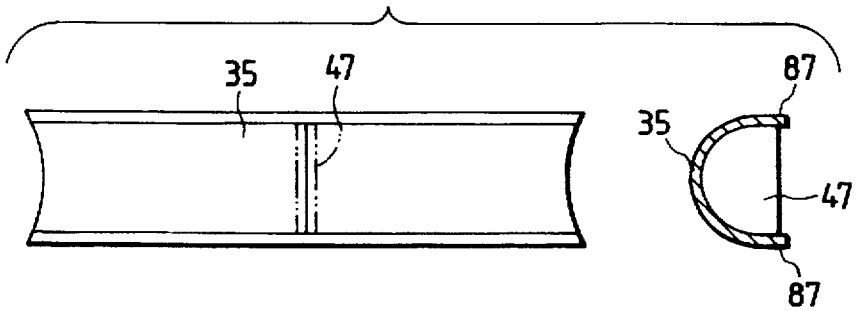
FIG. 24 shows an edge-forming process for the second header member in the third example of partitioned header-producing method.

Then, in a compressing process as in FIGS. 5 and 6, the partition-forming portion 39 is compressed from the opposite sides to form the half partition portion 47. Thereafter, in an edge-forming process, the opposite side edge portions 87 of the second half-cylindrical portion 35 are formed into an arcuate shape conforming to the half-cylindrical portion 35, as shown in FIG. 24.

Figure 25:
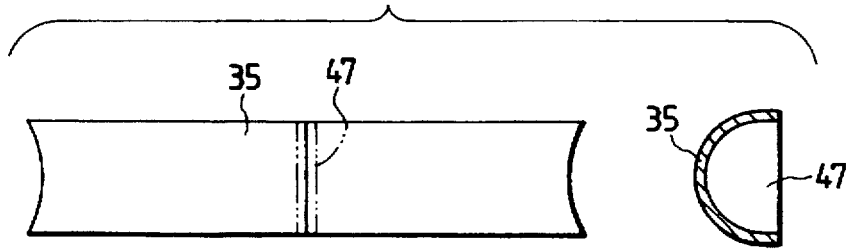
FIG. 25 shows an edge-cutting process for the second header member in the third example of partitioned header-producing method.
Figure 26:
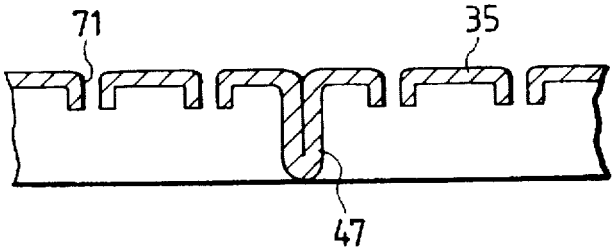
FIG. 26 is a view showing a tube insertion hole-forming process for the second header member in the third example of partition header-producing method.
Figure 27A:
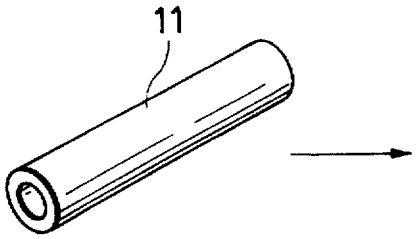
FIGS. 27A to 27D are views showing a process for producing a conventional partitioned pipe.
Figure 27B:
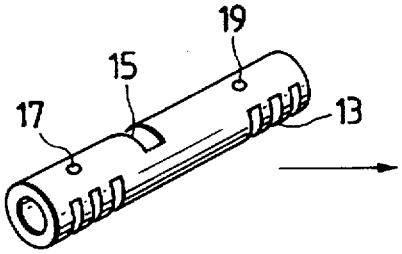
Figure 27C:
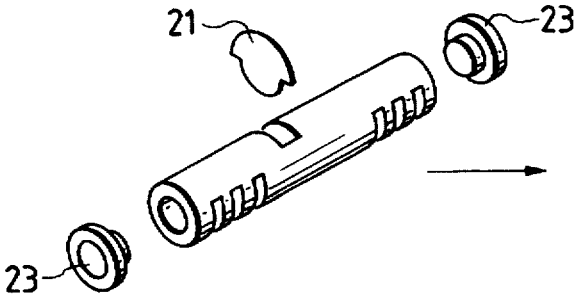
Figure 27D:
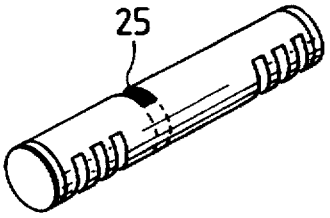

Then, the edge portions 87 are cut in such a manner that these edge portions 87 can lie in a plane in which the distal end of the half partition portion 47 lies, as shown in FIG. 25. Thereafter, the tube insertion holes 71 are formed in the second half-cylindrical portion 35, as shown in FIG. 26. The tube insertion holes 71 may be formed at any time after the formation of the half-cylindrical portion 35.

In this method of producing the partitioned header for the type of heat exchanger within which the cooling medium makes one U-turn, the bonding process is carried out in the following manner. The tube insertion holes 71, formed in the second header member 80*b* (which is mated with the first header member 80*a* to assemble the header 80, with the lid members 73 fitted respectively on the opposite ends of this header), are fitted on one ends of tubes of a core portion (comprising fins and tubes) of the heat exchanger whereas tube insertion holes in a header with no partition are fitted respectively on the other ends of the tubes, and in this condition these parts are fixed relative to each other by a jig or the like. Then, the bonding is carried out by a brazing method using a non-corrosive flux, or vacuum brazing. At this time, the brazing material on the outer surface of the header melts, and is drawn into a gap between bonding portions of the first and second header members 80*a* and 8*b* and also into a gap between the two half partition portions 86 and 47, thus effecting the brazing.

There is no need to use an expensive pipe material preformed into a cylindrical shape, and the material cost can be reduced greatly as compared with the conventional method.

In contrast with the conventional method using a cylindrical pipe, the partition is formed integrally with the header, and therefore the number of component parts is reduced, and hence the cost can be reduced. Since the brazing of the partition portion is effected within the header, leakage of the cooling medium to the exterior due to defective brazing of the partition portion is prevented, thereby enhancing the brazing ability.

Furthermore, since the tube insertion holes can be formed in a semi-circular shape, a tube insertion hole-forming die can have a sufficient strength, and the time required for forming the tube insertion holes can be shortened, which reduces the cost.

Figure 30:
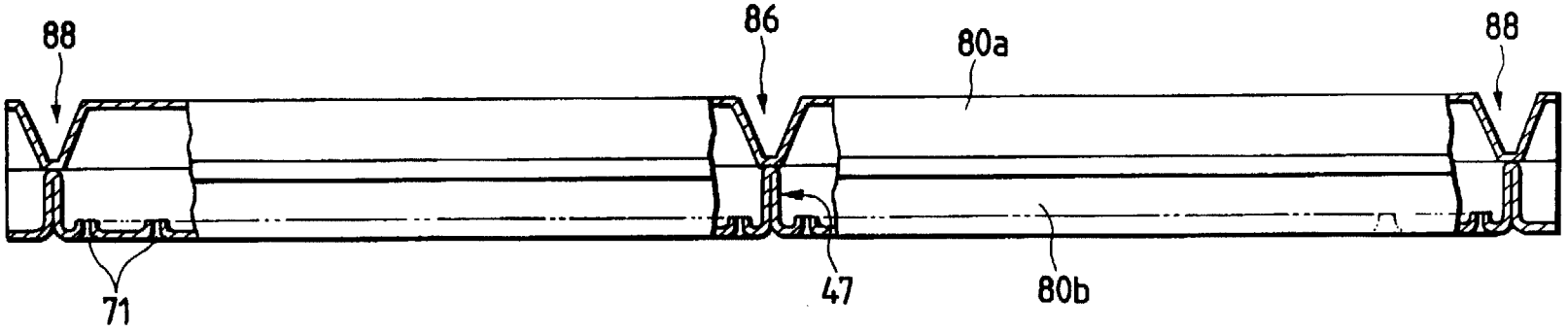
FIG. 30 is a side view showing an end-closed header for a heat exchanger produced by the similar manner such as that of the partitioned header shown in FIGS. 18A and 18B.

FIG. 30 shows an end-closed header similar to the partitioned header in FIGS. 18A and 18B. In this header, half closure portions 88, as the closure portion are formed at the both ends by the same producing method as that of the half partition portions 86, 47.

Figure 31:
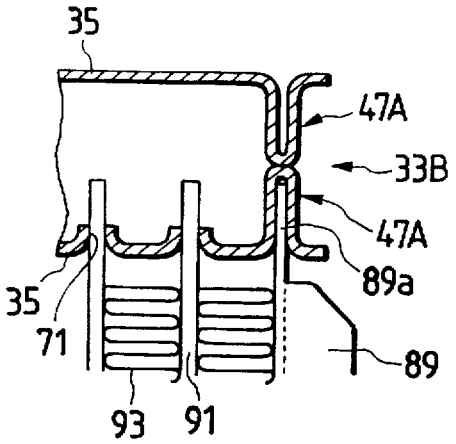
FIG. 31 is another example of an end-closed header for a heat exchanger of the invention.

FIG. 31 shows another embodiment of a header of the invention for a heat exchanger. In this embodiment, a closure portion 33B, provided at ends of half-cylindrical portions 35, is formed by half closure portion 47A of a U-shaped cross-section bonded together.

An end portion 89*a* of a reinforcement 89 is fixedly fitted in the half closure portion 47A of that half-cylindrical portion 35 having tube insertion holes 71 formed therein.

Tubes 91 are fitted in the tube insertion holes 71, respectively, and corrugated fins 93 are provided between the tubes 91 and also between the tube 91 and the reinforcement 89.

In the heat exchanger header, since the end portion 89*a* of the reinforcement 89 is fitted in the half closure portion 47A, the end portion 89*a* of the reinforcement 89 can be fixedly secured to the header body easily and positively.

Figure 32:
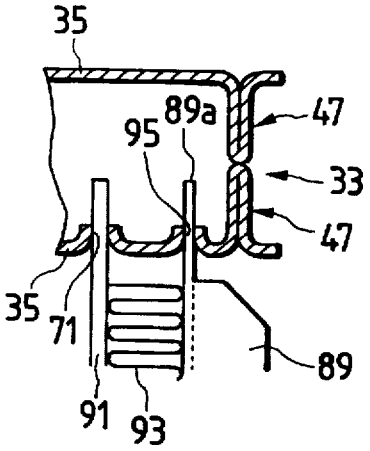
FIG. 32 is another example of an end-closed header for a heat exchanger of the invention.

FIG. 32 shows another embodiment of a header of the invention for a heat exchanger. In this embodiment, a reinforce insertion hole 95 is formed through that half-cylindrical portion 35 having tube insertion holes 71 formed therein, and is disposed axially inwardly of a half closure portion 47 thereof.

The end portion 89*a* of the reinforcement 89 is fixedly fitted in this reinforcement insertion hole 95.

In this embodiment, also, the end portion 89*a* of the reinforcement 89 can be fixedly secured to the header body easily and positively.

Figure 33:
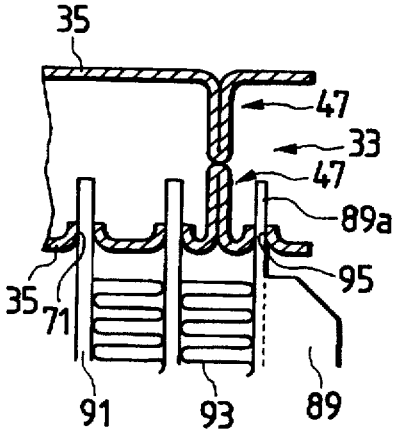
FIG. 33 is still another example of an end-closed header for a heat exchanger of the invention.

FIG. 33 shows still another embodiment of a header of the invention for a heat exchanger. In this embodiment, a reinforce insertion hole 95 is formed through that half-cylindrical portion 35 having tube insertion holes 71 formed therein, and is disposed axially outwardly of a half closure portion 47 thereof.

The end portion 89*a* of the reinforcement 89 is fixedly fitted in this reinforcement insertion hole 95.

In this embodiment, also, the end portion 89*a* of the reinforcement 89 can be fixedly secured to the header body easily and positively.

A modified first header member is formed by the same method of forming the second header member 80*b* except for the step of forming the tube insertion holes. Those portions of the first and second headers joined together are not limited to the configuration shown in the above embodiment, and may have any other suitable configuration.

In the above embodiments, although the single partition portion is provided, the present invention is not to be limited to such an arrangement.

Further, although the headers in the above embodiments have a circular cross-section, the headers can have any other suitable cross-section.

In all of the above embodiments, although the aluminum alloy sheet, having the brazing material clad or formed on one surface thereof serving as the outer peripheral surface of the resulting pipe or header, is used, the cladding of the brazing material is not limited to this surface, and the brazing material may be clad on the other surface of the sheet serving as the inner peripheral surface of the resulting pipe or header, or may be clad on the opposite sides of the sheet.

Instead of using the cladding of the brazing material, the brazing material may be placed on those portions to be brazed so as to effect the brazing.

Additionally, although a single partition portion is provided in each of the above embodiments, the present invention is not to be limited to such an arrangement. A plurality of such partition portions may, of course, be provided in the manner described above.

As described above, in the partitioned-pipe producing method according to the first aspect of the invention, the partition-forming portion, formed on each of the pair of half-cylindrical portions, is compressed from the opposite side thereof to form the half partition portion, and when the pair of half-cylindrical portions are mated together, the pair of half partition portions are mated together to form the partition portion. Thus, the pipe, having the integrally-formed partition portion, can be easily formed from the single sheet. By using the brazing material-clad sheet, the pair of half-cylindrical portions, as well as the pair of half partition portions, are bonded together by brazing, and therefore these portions can be bonded positively.

In the partitioned header-producing method according to the second embodiment, the header, having the integrally-formed partition portion, can be easily formed from the single sheet. By using the brazing material-clad sheet, the pair of half-cylindrical portions, as well as the pair of half partition portions, are positively bonded together by brazing, thereby positively preventing a heat transfer medium from leaking from the heat exchanger.

What is claimed is:

1. A method of producing a pipe with a partition, comprising the steps of:

shaping a flat sheet into such a configuration that said sheet has a pair of half-cylindrical portions arranged in juxtaposed relation to each other and interconnected by a connecting portion disposed between said pair of half-cylindrical portions, and that a partition-forming portion of a U-shaped cross-section is formed on each of said pair of half-cylindrical portions, and is projected from an inner surface thereof;

removing at least that portion of said connecting portion lying between said partition-forming portions of said pair of half-cylindrical portions;

compressing each of said partition-forming portions from opposite sides thereof to form a half partition portion;

bending said connecting portion to bring said pair of half-cylindrical portions into opposed relation to each other;

mating said pair of opposed half-cylindrical portions with each other; and bonding said pair of mated half-cylindrical portions together.

2. The method of claim 1, wherein said flat sheet comprises an aluminum sheet having a brazing material layer formed thereon, and in said bonding step, said pair of half cylindrical portions, as well as said half partition portions, are brazed together.

3. The method of claim 1, further comprising the step 2 of forming tube insertion holes in one of said pair of half-cylindrical portions.

4. The method of claim 3, wherein said flat sheet comprises an aluminum sheet having a brazing material layer formed thereon, and in said bonding step, said pair of half cylindrical portions, as well as said half partition portions, are brazed together.

5. The method of claim 1, further comprising the steps of cutting a slit in an end of one of said partition-forming portions and flaring said cut end outwardly to form a flared portion, another of said partition-portions being received in said flared portion.

6. The method of claim 1, further comprising the steps of forming a first set of projections in an outer side edge of one of said half-cylindrical portions and a second set of projections in another of said half-cylindrical portions in an alternating manner, said first and second sets of projections respectively mating with the opposed cylindrical portions.

7. The method of claim 1, wherein edges of said half-cylindrical portions are bent in an L-shape.

8. A method of producing a header with a partition, comprising the steps of:

shaping a flat sheet to form a first header member which has a first half-cylindrical portion, and a partition portion of a generally U-shaped cross-section projected from an inner surface of said half-cylindrical portion;

forming a second header member, said second header member-forming step comprising the steps of (i) shaping a flat sheet to form a second half-cylindrical portion having a partition-forming portion of a U-shaped cross-section projected from an inner surface thereof, (ii) removing at least those portions of opposite side edge portions of said second half-cylindrical portion disposed respectively at opposite ends of said partition-forming portion, (iii) compressing said partition-forming portion from opposite sides thereof to form a half partition portion, and (iv) forming tube insertion holes in said second half-cylindrical portion; and bonding said first and second header members together.

9. A method of producing a header with a partition, comprising the steps of:

forming a first header member, said first header member-forming step comprising the steps of (i) shaping a flat sheet to form a first half-cylindrical portion having a first partition-forming portion of a generally U-shaped cross-section projected from an inner surface thereof, (ii) removing at least those portions of opposite side edge portions of said half-cylindrical portion disposed respectively at opposite ends of said partition-forming portion, (iii) compressing said partition-forming portion from opposite sides thereof to form a first half partition portion;

forming a second header member, said second header member-forming step comprising the steps of (iv) shaping a flat sheet to form a second half-cylindrical portion having a second partition-forming portion of a U-shaped cross-section projected from an inner surface thereof, (v) removing at least those portions of opposite side edge portions of said second half-cylindrical portion disposed respectively at opposite ends of said second partition-forming portion, (vi) compressing said second partition-forming portion from opposite sides thereof to form a second half partition portion, and (vii) forming tube insertion holes in said second half-cylindrical portion; and joining said first and second header members together to form a header having a pipe-like configuration.

10. The method of claim 9, further comprising the steps of cutting a slit in an end of said first partition-forming portion and flaring said cut end outwardly to form a flared portion, said second partition-portion being received in said flared portion.

11. The method of claim 9, further comprising the steps of forming a first set of projections in an outer side edge of said first half-cylindrical portion and a second set of projections in said second half-cylindrical portion in an alternating manner, said first and second sets of projections respectively mating with said second half-cylindrical portion and said first half-cylindrical portion.

12. The method of claim 9, wherein edges of said first and second half-cylindrical portions are bent in an L-shape.

13. A method of producing an end-closed pipe in which an end portion is closed, comprising the steps of:

shaping a flat sheet into such a configuration that said sheet has a pair of half-cylindrical portions arranged in juxtaposed relation to each other and interconnected by a connecting portion disposed between said pair of half-cylindrical portions, and that a closure-forming portion of a U-shaped cross-section is formed on each of said pair of half-cylindrical portions at the end thereof, and is projected from an inner surface thereof;

removing at least that portion of said connecting portion lying between said closure-forming portions of said pair of half-cylindrical portions;

compressing each of said closure-forming portions from opposite sides thereof to form a half closure portion;

bending said connecting portion to bring said pair of half-cylindrical portions into opposed relation to each other;

mating said pair of opposed half-cylindrical portions with each other; and bonding said pair of mated half-cylindrical portions together.

14. The method of claim 13, wherein said flat sheet comprises an aluminum sheet having a brazing material layer formed thereon, and in said bonding step, said pair of half cylindrical portions, as well as said half closure portions, are brazed together.

15. The method of claim 13, further comprising the step of forming tube insertion holes in one of said pair of half-cylindrical portions.

16. The method of claim 14, wherein said flat sheet comprises an aluminum sheet having a brazing material layer formed thereon, and in said bonding step, said pair of half cylindrical portions, as well as said half partition portions, are brazed together.

17. The method of claim 13, wherein said half closure portions are formed at both end portions of each of said pair of half-cylindrical portions to close both end portions of said end-closed pipe.

18. The method of claim 13, further comprising the steps of cutting away an outside portion of said closure-forming portion to remove a needless portion.

19. The method of claim 17, further comprising the steps of forming a partition between both end of said end-closed pipe in accordance with the same steps of shaping, removing and compressing.

20. A method of producing a header of which end portion is closed, comprising the steps of:

shaping a flat sheet to form a first header member which has a first half-cylindrical portion, and a closure portion of a generally U-shaped cross-section projected from an inner surface of said half-cylindrical portion;

forming a second header member, said second header member-forming step comprising the steps of (i) shaping a flat sheet to form a second half-cylindrical portion having a closure-forming portion of a U-shaped cross-section projected from an inner surface thereof, (ii) removing at least those portions of opposite side edge portions of said second half-cylindrical portion disposed respectively at opposite ends of said closure-forming portion, (iii) compressing said closure-forming portion from opposite sides thereof to form a half closure portion, and (iv) forming tube insertion holes in said second half-cylindrical portion; and bonding said first and second header members together.

21. The method of claim 20, wherein said flat sheet is shaped in such a manner that said first half-cylindrical portion has said closure portions at both end portions thereof and said second half-cylindrical portion has said half closure portions at both end portions thereof, so as to close both end portions of said header.

22. The method of claim 20, further comprising the steps of cutting away an outside portion of said closure portion and half closure portion to remove a needless portion.

23. The method of claim 21, further comprising the steps of forming a partition between both ends of said end-closed pipe in accordance with the same steps (i) to (iii).

24. A method of producing a header of which end portion is closed, comprising the steps of:

forming a first header member, said first header member-forming step comprising the steps of (i) shaping a flat sheet to form a first half-cylindrical portion having a first closure-forming portion of a generally U-shaped cross-section projected from an inner surface thereof, (ii) removing at least those portions of opposite side edge portions of said half-cylindrical portion disposed respectively at opposite ends of said closure-forming portion, (iii) compressing said closure-forming portion from opposite sides thereof to form a first half closure portion;

forming a second header member, said second header member-forming step comprising the steps of (iv) shaping a flat sheet to form a second half-cylindrical portion having a second closure-forming portion of a U-shaped cross-section projected from an inner surface thereof, (v) removing at least those portions of opposite side edge portions of said second half-cylindrical portion disposed respectively at opposite ends of said second closure-forming portion, (vi) compressing said second closure-forming portion from opposite sides thereof to form a second half closure portion, and (vii) forming tube insertion holes in said second half-cylindrical portion; and joining said first and second header members together to form a header having a pipe-like configuration.

25. The method of claim 24, wherein said flat sheet is shaped in such a manner that said first half-cylindrical portion has said first closure-forming portions at both end portions thereof and said second half-cylindrical portion has said second closure-forming portions at both end portions thereof, so as to close both end portions of said header.

26. The method of claim 24, further comprising the steps of cutting away an outside portion of said first and second closure-forming portions to remove a needless portion.

27. The method of claim 25, further comprising the steps of forming a partition between both end of said end-closed pipe in accordance with the same steps (i) to (iv).

* * * * *